US007201606B2

(12) United States Patent
Matsuoka

(10) Patent No.: US 7,201,606 B2
(45) Date of Patent: Apr. 10, 2007

(54) WIRE CONNECTION STRUCTURE AND CONNECTOR

(75) Inventor: Hiroyuki Matsuoka, Yokohama (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/556,860

(22) PCT Filed: Apr. 20, 2004

(86) PCT No.: PCT/US2004/012135

§ 371 (c)(1),
(2), (4) Date: Nov. 14, 2005

(87) PCT Pub. No.: WO2004/109862

PCT Pub. Date: Dec. 16, 2004

(65) Prior Publication Data

US 2006/0252301 A1 Nov. 9, 2006

(30) Foreign Application Priority Data

May 30, 2003 (JP) ..... 2003-154884

(51) Int. Cl.
*H01R 12/00* (2006.01)

(52) U.S. Cl. ..... 439/499

(58) Field of Classification Search ..... 439/67, 439/499, 495

See application file for complete search history.

(56) References Cited

U.S. PATENT DOCUMENTS 6,039,611 A * 3/2000 Yang ..... 439/701
6,217,344 B1 * 4/2001 Saito et al. ..... 439/67
6,358,083 B1 * 3/2002 Kraft ..... 439/488
6,419,502 B1 * 7/2002 Trammel ..... 439/79
6,648,697 B2 * 11/2003 Yang ..... 439/701
6,905,366 B2 * 6/2005 Yang ..... 439/607
7,070,444 B2 * 7/2006 Sato et al. ..... 439/496

FOREIGN PATENT DOCUMENTS

| | | |
|---|---|---|
| EP | 1 041 682 A1 | 10/2000 |
| GB | 903064 | 8/1962 |
| JP | 2000-277190 | 10/2000 |
| JP | 2000-306622 | 11/2000 |

* cited by examiner

*Primary Examiner*—Neil Abrams
*Assistant Examiner*—Phuongchi Nguyen
(74) *Attorney, Agent, or Firm*—Melanie G. Gover

(57) ABSTRACT

A body of a connector is constituted by combining a first support member for supporting a plurality of terminal elements with a second support member for supporting the first support member. The second support member has a plurality of bearing surfaces individually opposed to conductor-connecting sections of the terminal elements supported by the first support member. The first support member and the second support member are assembled with each other to arrange the wire conductors C between the conductor-connecting sections of the terminal elements and the corresponding bearing surfaces. An abutting member is assembled with the body. The abutting member has a pressing surface for uniformly pressing the conductor-connecting sections of the terminal elements supported by the first support member toward the corresponding bearing surfaces of the second support member.

2 Claims, 7 Drawing Sheets

WIRE CONNECTION STRUCTURE AND CONNECTOR

BACKGROUND OF THE INVENTION

1. Technical Field of the Invention

The present invention relates to a mutual connection structure between a wire conductor and a terminal element, and particularly to a wire connection structure including an abutting member for abutting the wire conductor to the conductor-connecting section of the terminal element under pressure. Further, the present invention relates to a connector employing such a wire connection structure.

2. Prior Art

Two kinds of mutual connection structures between wire conductors and terminal elements have been known in the prior art; one being a so-called crimp fitting structure in which a wire conductor of a predetermined length exposed by removing a sheath from an end portion of the wire is connected to a conductor-connecting section of the terminal element by the plastic deformation (i.e., the caulking) of the latter, and the other being a so-called insulation-displacement structure in which a slit having a width smaller than a diameter of the wire conductor is provided in the conductor-connecting section of the terminal element to have a sharp profile, and the conductor-connecting section is pierced into the wire through the sheath thereof to press the conductor into the slit. These well-known wire connection structures have recently become unsatisfactory both in workability of the connecting operation and in processability of the terminal element, because the diameter of the wire conductor is smaller and the arrangement pitch of the terminal elements is narrower in correspondence to the recent demand for a high-density connection. As countermeasures for the high-density connection, various wire-connection structures are proposed, in which a wire conductor of a predetermined length exposed by removing a sheath from an end portion of the wire is brought into contact with a conductor-connecting section of a terminal element under a pressure (see, for example, Patent Document No. Japanese Unexamined Patent Publication (Kokai) No. 2000-277190 and Patent Document Japanese Unexamined Patent Publication (Kokai) No. 2000-306622).

According to the wire connection structure of the above conductor-abutting type disclosed in Patent Document No. Japanese Unexamined Patent Publication (Kokai) No. 2000-277190, a connector suitably applied to a multi-core type flat cable is proposed, comprising a plurality of terminal elements, each having a conductor-connecting section to be connected to the wire conductor, an electrically insulative body supporting the terminal elements while exposing the respective conductor-connecting sections therefrom, and a plurality of abutting members incorporated in the body to abut the individual wire conductors to the conductor-connecting sections of the terminal elements under a pressure. In this connector, the respective terminal element (a base contact) is provided with the conductor-connecting section having a curved edge, while the respective abutting member (a support contact) formed of a conductive metallic piece similar to the terminal element is provided with a curved contact surface in correspondence to the curved edge of the conductor-connecting section of the terminal element. The body supporting the terminal elements arranged at a predetermined pitch is assembled with an electrically insulative cover supporting the abutting members arranged at the corresponding pitch, while intervening the cable to be connected between the both, in the direction transverse to the cable-extending direction. Thus, the conductors in the cable are fixedly nipped under a pressure between the terminal elements and the abutting members corresponding thereto while being forcibly curved along the edge of the conductor-connecting section of the terminal element and the curved profile of the contact surface of the abutting member.

According to the wire connection structure of the above conductor-abutting type disclosed in Patent Document No. Japanese Unexamined Patent Publication (Kokai) No. 2000-306622, similar to the wire connection structure of Patent Document No. Japanese Unexamined Patent Publication (Kokai) No. 2000-277190, the conductor-connecting section having the curved edge is provided in the respective terminal element (a base contact), while the contact surface curved in correspondence thereto is provided in the respective abutting member. The body supporting the terminal elements arranged at a predetermined pitch is assembled with a pair of electrically insulative covers supporting the abutting members arranged at the corresponding pitch between the both, while nipping the cable to be connected between both the covers, in the direction parallel to the cable-extending direction. Thus, the conductors in the cable are fixedly nipped under a pressure between the terminal elements and the abutting members corresponding thereto while being forcibly curved along the edge of the conductor-connecting section of the terminal element and the curved profile of the contact surface of the abutting member.

The wire connection structure disclosed in the above-mentioned Patent Document Nos. Japanese Unexamined Patent Publication (Kokai) No. 2000-277190 and Japanese Unexamined Patent Publication (Kokai) No. 2000-306622 is adapted to nip the wire conductor between the edge of the conductor-connecting section of the terminal element and the abutment surface of the abutting member under a pressure generated due to the relative movement of the terminal element to the abutting member. Accordingly, since the wire conductor is rubbed by the metallic piece under a pressure, there is a risk in that the wire conductor may be damaged during the wire-connecting operation.

Also, a cable of semi-hard copper alloy conductor excellent in bending property is recently beginning to be employed in an electronic/information equipment having an open/close type display, such as a note type personal computer or a portable telephone, which cable is used for connecting the equipment body to the display while bridging over a hinge portion. The semi-hard conductor of such a kind exhibits a high-level durability against bending or twisting and is rich in shape-recovery property. Accordingly, if the wire-connecting structure disclosed in the above-mentioned Patent Document Nos. 2000-277190 and Japanese Unexamined Patent Publication (Kokai) No. 2000-306622 is applied to the cable of the semi-hard conductor of this kind, it is very difficult to dispose the cable conductor in advance along the curved edge of the conductor-connecting section of the terminal element or the curved abutment surface of the abutting member during the connecting operation, due to the shape-recovery property of the cable conductor. Thereby, the straightly extending cable conductor is gradually nipped between the curved edge of the conductor-connecting section of the terminal element and the curved abutment surface of the abutting member while being forcibly curved by the relative movement of the terminal element to the abutting member. In this operation, there is a risk in that the cable conductor is liable to deflect from a proper position relative to the terminal element and the abutting member during the forcible bending operation, and as a result, the stability and the reliability is lowered in the conductive contact between the cable conductor and the terminal element.

An object of the present invention is to provide a wire-connection structure ensuring the stability and the reliability in the conductive contact between the cable conductor and the terminal element even if the semi-hard conductor wire is used.

Another object of the present invention is to provide a connector of a high-density connection type in correspondence to the reduction of the diameter of the conductor wire and the arrangement pitch of the terminal element by employing such a wire-connection structure as excellent in the stability and the reliability.

SUMMARY OF THE INVENTION

One embodiment according to the invention provides a wire connection structure comprising a terminal element having a conductor-connecting section connectable to a wire conductor, an electrically insulative support for supporting the terminal element with the conductor-connecting section being exposed, and an abutting member for abutting a wire conductor to the conductor-connecting section of the terminal element under pressure, characterized in that the support includes a first support section supporting the terminal element and a second support section having a bearing surface opposed to the conductor-connecting section of the terminal element supported on the first support section, a wire conductor being disposed between the conductor-connecting section and the bearing surface; and that the abutting member includes a pressing surface acting to push the conductor-connecting section of the terminal element supported on the first support section toward the bearing surface of the second support section.

Another embodiment according to the invention provides a connector comprising a terminal element having a conductor-connecting section connectable to a wire conductor, an electrically insulative body for supporting the terminal element with the conductor-connecting section being exposed, and an abutting member assembled with the body for abutting a wire conductor to the conductor-connecting section of the terminal element under pressure, characterized in that the body includes a first support member supporting the terminal element and a second support member supporting the first support member and having a bearing surface opposed to the conductor-connecting section of the terminal element supported on the first support member, the first support member and the second support member being combined with each other to permit a wire conductor to be disposed between the conductor-connecting section and the bearing surface; and that the abutting member includes a pressing surface acting to push the conductor-connecting section of the terminal element supported on the first support member toward the bearing surface of the second support member when the abutting member is assembled with the body.

Another embodiment according to the invention provides a connector as described above, wherein the terminal element includes a spring section adjacent to the conductor-connecting section; and wherein the abutting member presses the spring section of the terminal element by the pressing surface, upon being assembled with the body, so that a wire conductor is held between the conductor-connecting section and the bearing surface under a spring force generated in the spring section.

Another embodiment according to the invention provides a connector as described above, wherein the abutting member includes a projection having the pressing surface; and wherein the second support member includes a recess for receiving the projection of the abutting member.

DETAILED DESCRIPTION

The preferred embodiments of the present invention will be described in detail below with reference to the attached drawings, through which common reference numerals are used for denoting the corresponding constituent elements.

FIGS. 1(*a*), 1(*b*) and 2 are perspective views, respectively, of wire-connection structure according to a first embodiment of the present invention and a connector 10 employing the same and FIGS. 3 to 5 are sectional views, respectively, of main constituent elements of the connector The illustrated wire-connection structure is of a conductor-abutting type in which a conductor C exposed by removing a sheath S from a required length of an end portion of an electric wire W is abutted to and connected with a conductor-connecting section 14 of a terminal element 12 under a pressure, and is applicable not only to a connector for a multi-core cable illustrated but also to other various connectors or terminal boxes.

The wire-connection structure employed in the connector 10 includes a terminal element 12 having a conductor-connecting section 14 connectable to the wire conductor C, an electrically insulative support 16 for supporting the terminal element 12 while exposing the conductor-connecting section 14, and an abutting member 18 for abutting the wire conductor C to the conductor-connecting section 14 of the terminal element 12 under pressure. The support 16 includes a first support section 20 for supporting the terminal element 12 and a second support section 24 having a bearing surface 22 opposed to the conductor-connecting section 14 of the terminal element 12 supported by the first support member 20, so that the wire conductor C is arranged between the conductor-connecting section 14 and the bearing surface 22. The abutting member 18 has a pressing surface 26 for pressing the conductor-connecting section 14 of the terminal element 12 supported by the first support member 20 onto the bearing surface 22 of the second support member 24.

The connector 10 employing the above wire-connection structure includes a plurality of terminal elements 12, each having a conductor-connecting section 14 connectable to the wire conductor C, an electrically insulative body (or the support) 16 supporting the terminal elements 12 while exposing the individual conductor-connecting sections 14, and an abutting member 18 assembled to the body 16 for abutting the wire conductors C to the individual conductor-connecting sections 14 of the terminal elements 12 under pressure. The body 16 is structured by securely combining a first support member (or the first support section) 20 for supporting the terminal elements 12 with a second support member (or the second support section) 24 for supporting the first support member 20. The second support member 24 has a plurality of bearing surfaces 22 capable of being opposed to the respective conductor-connecting sections 14 of the terminal elements 12 supported by the first support member 20. The first support member 20 and the second support member 24 are combined so that the respective wire conductors C are arranged between the conductor-connecting sections 14 of the terminal elements 12 and the corresponding bearing surfaces 22. The abutting member 18 has a pressing surface 26 for uniformly pressing the conductor-connecting sections 14 of the terminal elements 12 supported by the first support member 24 onto the bearing surfaces 22 of the second support member 24 corresponding thereto.

The terminal elements 12 in the connector 10 are attached to the first support member 20 of the body 16, for example, by the insert molding and arranged parallel to each other at a predetermined pitch. The respective terminal element 12 is a pin-like member blanked from an electrically conductive metallic sheet to have a predetermined shape, and includes an embedded section 28 at one end thereof to be embedded in the first support member 20 and a conductor-connecting section 14 at the other end thereof integral with the former, extending from the embedded section 28 and projected outward from the first support member 20. Part of the embedded section 28 of the terminal element 12 is exposed on one surface 20*a* of the first support member 20 to constitute a contact section 30 to be brought into conductive-contact with a terminal element of the other connector to be connected to the connector 10. Also, the conductor-connecting section 14 of the terminal element 12 has a beam section 14*a* disposed adjacent to the embedded section 28 and extending substantially parallel thereto and an arm section 14*b* disposed adjacent to the beam section 14*a* and extending in the direction transverse thereto.

The respective terminal element 12 further has a spring section 32 disposed adjacent to the embedded section 28 on the side opposite to the latter and extending from the conductor-connecting section 14. The spring section 32 has a second arm section 32*a* extending from the arm section 14*b* of the conductor-connecting section 14 while curving in an S-shape, and a pressure-receiving section 32*b* formed at a distal end of the second arm section 32*a*. The conductor-connecting section 14 and the spring section 32 of the respective terminal element 12 are held by the first support member 20 in a cantilever manner and elastically deformable by an external force. Particularly, the second arm section 32*a* of the spring section 32 is elastically flexible to bring the arm section 14*b* of the conductor-connecting section 14 near to the pressure-receiving section 32*b* of the spring section 32 and generate a spring force proportional to an amount of strain. The arm section 14*b* of the conductor-connecting section 14 and the pressure-receiving section 32*b* of the spring section 32 are apart from each other by the maximum distance (between the outer surfaces thereof) when both the conductor-connecting section 14 and the spring section 32 are not elastically deformed under no load. Note, the terminal element 12 may be press-fitted into a through hole previously formed in the first support member 12 of the body 16.

The first support member 12 of the body 16 is molded, for example, with resin to be a one-piece article for supporting the terminal elements 12 parallel to each other in the insulated state. The first support member 20 includes a main portion 34 having a surface 20*b* from which is projected the conductor-connecting section 14 of the respective terminal element 12, and an auxiliary portion 36 extending from the main portion 34 in the lateral direction and having a surface 20*a* from which is exposed the contact section 30 of the respective terminal element 12. In the boundary area between the main portion 34 and the auxiliary portion 36, a recess 38 of a rectangular cross-section is formed on a surface opposite to the surface 20*a* from which is exposed the contact section 30 of the terminal element 12. Between the surface 20*b* on the main portion 34 and the arm section 14*b* of the conductor-connecting section 14 in the terminal element 12, a space 40 having a required dimension is formed. The auxiliary portion 36 projects outward from the body 16 to form an engagement portion detachably engaged with the other connector to be connected, when the first support member 20 and the second support member 24 are properly combined with each other, as described later.

The second support member 24 of the body 16 is molded, for example, with resin to be a one-piece article and includes a first portion 42 engageable with the main portion 34 of the first support member 20, a second portion 44 disposed adjacent to the first portion 34 and having the bearing surfaces 22 described above, a third portion 46 disposed adjacent to the second portion 44 for carrying a plurality of wires W to be connected, and a fourth portion 48 disposed adjacent to the first to third portions 42, 44 and 46 to be engageable with the abutting member 18. The first portion 42 constitutes an area extending along one side of a rectangular plane of the second support member 24. In the first portion 42, a recess 50 is formed for accommodating the main portion 34 of the first support member 20 without any play, and as one of peripheral walls defining the recess 50, a rectangular projection 52, part of which is defined by the outer surface of the first portion 42, is formed to have a dimension and a shape accommodated in the recess 38 of the first support member 20 without any play. Accordingly, the first support member 20 and the second support member 24 are fixedly combined with each other by the complementary operation between the main portion 34 and the recess 38 in the former and the recess 50 and the projection 52 of the first portion 42 in the latter so that no relative movement occurs.

The second portion 44 of the second support member 24 constitutes an intermediate area adjacent to the recess 50 on the side opposite to the projection 52 of the first portion 42. In the second portion 44, a plurality of partitions 54 exhibiting a bulged profile to the recess 50 are formed parallel to each other at a constant gap. Between every adjacent partitions 54, a groove 56 having a bottom surface extending while curving in a crank-shape is communicated to the recess 50. The bearing surfaces 22 formed in the second portion 44 are constituted by a vertical portion which is part of the bottom surface of these grooves 56 and located opposite to the recess 50 in the first portion 42. When the first support member 20 and the second support member 24 are properly combined, the conductor-connecting sections 14 of the terminal elements 12 projected from the main portion 34 in the first support member 20 are individually accommodated in the grooves 56 provided in the second portion 44 in the second support member 24, and the partition 54 is interposed between the conductor-connecting sections 14 of the adjacent terminal elements 12. At that time, the arm section 14*b* of the conductor-connecting section 14 in the respective terminal element 12 is located opposite to the bearing surface 22 in the groove 56 corresponding thereto.

The third portion 46 of the second support member 24 constitutes an area extending along the other side of a rectangular plane of the second support member 24 at a position opposite to the first portion 42. In the third portion 46, a plurality of partitions 58 extending from the partitions 58 are formed, and grooves 60 communicated to the respective grooves 56 in the second portion 44 are formed between every adjacent partitions 58. The grooves 60 in the third portion 46 respectively accommodate the wires W to be connected so that a length thereof having a sheath S is straightly extended. In the boundary region between the second portion 44 and the third portion 46, a recess 62 having a rectangular cross-section extends in the direction transverse to the grooves 56 and 60. The recess 62 is formed while maintaining a uniform positional relationship relative to the grooves 56, 60 by aligning recessed edges formed in the boundary area between the partitions 56 and 60 with each other in the transverse direction.

The fourth portion 48 of the second support member 24 constitutes an area along two opposite sides of the rectangular plane of the second support member 24 on the side different from the first and third portions 42 and 46. In the fourth portion 48, there are formed a pair of end surfaces 48*a* constituting a top surface of the second support member 24 opposed to the abutting member 18 and a pair of engagement grooves 64 recessed at a predetermined position on the respective end surfaces 48*a*.

The abutting member 18 is molded, for example, with resin as a one-piece body and provided with a rectangular plate-like main portion 66, a vertical wall-like projection 68 disposed generally at a center of one surface 66*a* of the main portion 66 adjacent thereto, having the above-mentioned pressing surface 26, and a pair of vertical wall-like fitting elements 70 disposed on the surface 60*a* at positions on the extension of the projection 68 and projected higher than the projection 68 with reference to the surface 66*a*. A plurality of ribs 72 straightly extending generally vertical to the pressing surface 26 while slightly bulging from the flat surface 66*a* are arranged in the main portion 66 to parallel to each other at a constant gap therebetween. Further, in the main portion 66, a generally flat holding surface 74 lower than the projection 68 but higher than the rib 72 with reference to the surface 66*a* is defined in an area between the pair of fitting elements 70 on the side opposite to the pressing surface 26 of the projection 68.

The projection 68 has a shape complementary with the recess 62 of the support member 24 in the body 16. The pressing surface 26 formed in the projection 68 flatly extends in the direction transverse to the surface 66*a* of the main portion 66, and has a shape and a dimension capable of uniformly being opposed to all of the bearing surfaces 22 provided in the second support member 24. The pair of fitting elements 70 are fixedly fitted into the pair of engagement grooves 64 formed in the fourth portion 48 of the second support member 24, and the respective fitting element has a pair of hooks 70*a* for this purpose. The abutting member 18 is fixedly assembled to the second support member 24 by engaging both the fitting elements 70 into the corresponding engagement grooves 64 of the second support member 24.

In a state in which the abutting member 18 is properly assembled with the second support member 24 of the body 16, the projection 68 of the abutting member 18 is received in the recess 62 of the second support member 24, and the pressing surface 26 of the projection 68 is disposed opposite to the bearing surfaces 22 of the second support member 24 to be parallel thereto at a gap therefrom. At this time, a gap between the pressing surface 26 of the abutting member 18 and the respective bearing surface 22 of the second support member 24 is designed to be smaller than the maximum distance L (see FIG. 3) between the arm section 14*b* of the conductor-connecting section 14 in the terminal element 12 and the pressure-receiving section 32*b* of the spring section 32 when no load is applied. Also, the main portion 66 of the abutting member 18 is brought into contact with the pair of end surfaces 48*a* of the fourth portion 48 in the second support member 24 by the surface 66*a* thereof, the ribs 72 are respectively accommodated in the grooves 56 in the second portion 44, and the holding surface 74 is substantially brought into contact with the partitions 58 in the third portion 46.

Processes will be described below for the connection of wires W in the connector 10 of the above-mentioned structure with reference to FIGS. 6(*a*), 6(*b*), 6(*c*) and 7.

At first, as the preparation, the sheath S is removed from an end portion of the multi-core cable (not shown) over a predetermined length to expose the conductors C of the wires W covered thereby. The wires W thus prepared are inserted into the second support member 24 while individually guiding the wires W along the grooves 60 formed in the third portion 46 (see FIG. 6(*a*)). At this time, a portion of the respective wire W having the sheath S is inserted into the corresponding groove 60 and the exposed conductor C is partially accommodated in the groove 56 of the second portion 44 in the second support member 24 communicated with the groove 60, while being maintained in a substantially straight state. In this regard, the respective wire W is required that the exposed conductor C extends substantially in a straight state until exceeding the bearing surface 22 provided in the groove 56 of the second support member 24. Preferably, the wire end is processed so that the conductor C has a length exceeding the recess 50 in the first portion 42.

As described above, the first support member 20 and the second support member 24 are complementary with each other by inserting the main portion 34 of the first member 20 into the recess 50 of the second support member 24 and the inserting the projection 52 of the second support member 24 into the recess 38 of the first support member 20 (see FIG. 6(*b*)). In this state, the conductor-connecting section 14 and the spring section 32 of the respective terminal element 12 supported by the first support member 20 are accommodated in the corresponding groove 56 in the second support member 24, whereby the conductor C of the wire W partially inserted in the groove 56 in advance is located between the respective conductor-connecting section 14 and the bottom of the corresponding groove 56. As a result, the conductor C of the wire W is forcibly conformed with the bottom of the corresponding groove 56 and nipped between the arm section 14*b* of the conductor-connecting section 14 in the respective terminal element 12 and the corresponding bearing surface 22 of the second support member 24, whereby the wire W is temporarily held in the groove 56.

While temporarily holding the wire W in such a state, the terminal elements 12 supported by the first support member 20 are located at positions at which the pressure-receiving section 32*b* of the respective spring section 32 projects into the recess 62 of the second support member 24. Simultaneously, as shown in FIG. 7, the wires W are located to be aligned with the terminal elements 12 along a given vertical plane $\alpha$ passing through the connector 10. As illustrated, since the terminal elements 12 and the wires W have no portions substantially extending in the direction transverse to the vertical plane $\alpha$, the arrangement pitch of the terminal elements 12 is reduced as small as possible. In this regard, in this temporarily holding state, it is unnecessary to apply a load to the wire conductor C between the arm section 14*b* of the conductor-connecting section 14 in the terminal element 12 and the corresponding bearing surface 22. However, it may be possible to temporarily hold the wire conductor C under a slight pressure caused by the elastic strain of the arm section 14 in the conductor-connecting section 14*b* itself in the direction to widen the above-mentioned space 40.

By fitting the pair of fitting elements 70 of the abutting member 18 into the corresponding engagement grooves 64 provided in the second support member 24 of the body 16 in which the conductors C of the wires W are temporarily held, the abutting member 18 and the body 16 are fixedly assembled (see FIG. 6(*c*)). In this state, the first support member 20 of the body 16 is nipped between the second support member 24 and the abutting member 18, whereby the wires W are maintained by the holding surface 74 of the abutting member 18 not to come off from the corresponding grooves 60. Simultaneously, the projection 68 of the abutting member 18 is inserted into the recess 62 of the second support member 24, and the pressing surface 26 of the projection 68 is disposed parallel to the bearing surfaces 22 of the second support member 24. Also, the ribs 72 of the abutting member 18 are inserted into the corresponding grooves 56 of the second support member 24 to be close to the spring sections 32 of the terminal elements 12 located in the grooves 56 from above in the drawing.

Since a gap between the pressing surface 26 of the projection 68 in the abutting member 18 inserted into the recess 62 of the second support member 24 and the respective bearing surface 22 in the second support member 24 is smaller than the maximum distance L between the arm section 14*b* of the conductor-connecting section 14 in the respective terminal element 12 and the pressure-receiving section 32*b* of the spring section 32 under no load, the pressing surface 26 of the projection 68 abuts to the pressure-receiving section 32*b* of the spring section 32 in the terminal element 12 projected into the recess 62 to uniformly push the pressure-receiving section 32*b* onto the corresponding bearing surface 22. Simultaneously, the ribs 72 of the abutting member 18 press the spring sections 32 of the terminal elements 12 downward in the corresponding grooves 56 from above to prevent the spring sections 32 from floating upward. Thereby, the arm section 14*b* of the conductor-connecting section 14 in the respective terminal element 12 is pushed toward the corresponding bearing surface 22, and the spring section 32 of the respective terminal element 12 is elastically strained between the pressing surface 26 and the bearing surface 22. As a result, the conductors C in the wires W temporarily maintained in the grooves 56 of the second support member 24 are fixedly nipped between the arm sections 14*b* of the conductor-connecting sections 14 in the respective terminal elements 12 and the corresponding bearing surfaces 22 of the second support member 24. In such a manner, the conductors C of the wires W are connected to the terminal elements 12 in the connector 10 under a required contact pressure in a stable manner.

According to the above-structured connector 10, since the body 16 is divided into the first support member 20 and the second support member 24 so that the conductors C in the wires W to be connected are arranged in advance between the conductor-connecting sections 14 in the terminal elements 12 held by the first support member 20 and the bearing surfaces 22 of the second support member 24, it is possible to avoid a situation in which the wire conductor C is abraded with a metallic piece under a pressure during the wire-connecting operation, and thus to eliminate a risk in that the wire conductor C is damaged. Since the pressing surface 26 uniformly push the conductor-connecting sections 14 of the terminal elements 12 toward the corresponding bearing surfaces 22 only by properly assembling the abutting member 18 with the body 16, it is possible to readily ensure a required contact pressure between the terminal elements 12 and the wire conductors C. In addition, since this contact pressure is obtained by the spring force generated from the spring section 32 of the respective terminal element 12, it is possible to ensure a required contact pressure in a stable manner without being influenced from a dimensional tolerance of various constituent members or the assembly error.

When the connector 10 is applied to wires having conductors made of semi-hard copper alloy excellent in flexibility, it is possible to temporarily maintain the semi-hard conductors rich in shape-recovery property between the conductor-connecting sections 14 and the bearing surfaces 22 while forcibly conforming the conductors with the bottoms of the grooves 56 in the second support member 24 by the conductor-connecting sections 14 in the terminal elements 12 supported by the first support member 20 during the wire connecting operation. According to the connector 10, even if the wire conductor C is made of such semi-hard copper alloy, it is possible to maintain the wire at a proper position relative to the conductor-connecting section 14 of the terminal element 12 during the connecting operation, and as a result, to ensure the conductive stability and reliability between the wire conductor C and the terminal element 12.

FIGS. 8(*a*), 8(*b*) and 8(*c*) illustrate a wire connection structure according to a second embodiment of the present invention and a connector 80 employing the same. The connector 80 has substantially the same structure as that of the preceding connector 10 except for the structure of a terminal element 82, and therefore, common reference numerals are used for denoting the corresponding constituent elements and the explanation thereof will be eliminated.

Each of a plurality of terminal elements 82 of the connector 80 is a pin-like member blanked from an electrically conductive metallic sheet to have a predetermined shape, and includes an embedded section 84 at one end thereof to be embedded in the first support member 20 and a conductor-connecting section 86 at the other end thereof integral with the former, extending from the embedded section 84 and projected outward from the first support member 20. Part of the embedded section 84 of the terminal element 12 is exposed on one surface 20*a* of the first support member 20 to constitute a contact section 30 to be brought into conductive-contact with a terminal element of the other connector to be connected to the connector 80. Also, the conductor-connecting section 86 of the terminal element 12 has a beam section 86*a* disposed adjacent to the embedded section 84 and extending substantially parallel thereto and an arm section 86*b* disposed adjacent to the beam section 86*a* and extending in the direction transverse thereto. The arm section 86*b* terminates at a distal end section 86*c* extending generally parallel to the beam section 86*a*. Accordingly, the terminal element 82 is different from the terminal element 12 in the connector 10 of the first embodiment in that no spring section exists adjacent to the conductor-connecting section 86.

The conductor-connecting sections 86 of the terminal elements 82 projected from the main portion 34 of the first support member 20 in the body 16 when the first support member 20 and the second support member 24 of the body 16 are accommodated in a plurality of grooves 56 in the second support member 24, and the partition 54 is interposed between the conductor-connecting sections 86 of every adjacent two terminal elements. At this time, the arm section 86*b* of the conductor-connecting section in the respective terminal element 82 is located opposite to the bearing surface 22 in the corresponding groove 56, and the boundary region between the beam section 86*a* and the arm section 86*b* of the conductor-connecting section 86 is partially projected into the recess 62 in the second support member 24. In this regard, according to the connector 80, in correspondence to such a structure of the terminal element 82, the recess 62 in the second support member 24 and the projection 68 in the abutting member 18 to be mated therewith have a dimension somewhat larger than that in the connector 10 of the first embodiment and the ribs 72 provided in the abutting member 18 in the connector 10 are omitted.

Processes for the connection of wires W in the connector 80 of the above-mentioned structure are as follows. First, the wires W which have been end-treated are temporarily arranged in the grooves 60 in the second support member 24 (see FIG. 8(*a*)). Then, the first support member 20 is assembled to the second support member 24 in a complementary manner (see FIG. 8(*b*)). In this state, the conductor-connecting section 86 of the respective terminal element 82 held in the first support member 20 is accommodated in the corresponding groove 56 in the second support member 24, whereby the conductor C of the wire W partially inserted into the groove 56 in advance is located between the respective conductor-connecting section 86 and the bottom of the corresponding groove 56. As a result, the conductor C of the wire W is forcibly conformed with the bottom of the corresponding groove 56 and nipped between the arm section 86*b* of the conductor-connecting section 86 in the respective terminal element 82 and the corresponding bearing surface 22 in the second support member 24. Thus, the conductor C of the wire W is temporarily maintained in the groove 56.

In this temporarily maintained state of the wire, the terminal elements 82 held by the first support member 20 are located at a position in which the beam section 86*a* and the arm section 86*b* of the respective conductor-connecting section 86 are partially projected into the recess 62 in the second support member 24. In this regard, in this temporarily maintained state of the wire, a pressure applied to the wire conductor C is substantially unnecessary between the arm section 86*b* of the conductor-connecting section 86 in the terminal element 82 and the corresponding bearing surface 22. However, as described with reference to the first embodiment, it may be possible to temporarily maintain the wire conductor C under a slight pressure generated by the elastic strain of the arm section 86*b* of the conductor-connecting section 86 itself.

The abutting member 18 is fixedly assembled to the body 16 in which the conductors C of the wires W are temporarily maintained as mentioned above (see FIG. 8(*c*)). In this state, the first support member 20 of the body 16 is fixedly nipped between the second support member 24 and the abutting member 18, and the wires W are held by the holding surface 74 of the abutting member 18 not to come off from the corresponding grooves 60. Simultaneously, the projection 68 of the abutting member 18 is inserted into the recess 62 in the second support member 24 and the pressing surface 26 of the projection 68 is arranged parallel to the bearing surfaces 22 of the second support member 24. At this time, the pressing surface 26 of the projection 68 abuts to the boundary region between the beam section 86*a* and the arm section 86*b* of the conductor-connecting section 86 in the respective terminal element 82 partially projected into the recess 62 to uniformly push the conductor-connecting section 86 toward the corresponding bearing surface 22. Thereby, the arm section 86*b* of the conductor-connecting section 86 in the respective terminal element 82 is pressed onto the corresponding bearing surface 22. As a result, the conductors C of the wires W temporarily maintained in the grooves 56 in the second support member 24 are fixedly nipped between the arm sections 86*b* of the conductor-connecting sections 86 in the respective terminal elements 82 and the corresponding bearing surfaces 22. In such a manner, the conductors C of the wires W are connected in a stable manner to the terminal elements 82 in the connector 80 under a required contact pressure.

It will be understood that the same operation and effect as in the connector 10 of the first embodiment described before are achievable even by the connector 80 of the above structure. In this regard, since the respective terminal element 82 in the connector 80 has no spring section adjacent to the conductor-connecting section 86, the connector 80 may be somewhat inferior to the connector 10 in a function for ensuring the contact pressure between the terminal element 82 and the wire conductor C in a stable manner. Instead, however, the terminal element 82 becomes simpler in structure. Also, since the straightly extended distal end section 86*c* can be provided at a distal end of the conductor-connecting section 86 in the terminal element 86 without taking the spring property into consideration, the operation is facilitated, for forcibly conforming the semi-hard conductor flexible rich in flexibility with the bottom of the groove 56 in the second support member 24.

The special operation and effect of the connector 10 or 80 is derived from the characteristic of the wire connection structure employed thereby. Particularly, since such a wire connection structure excellent in stability and reliability is employed in the connector 10 or 80, it is possible to realize the high-density connection structure in correspondence to the small diameter of the wire conductor C and the narrow-pitch arrangement of the terminal element 12 or 82. For example, according to the high-density connection structure obtained by the connector 10 or 80, an outer diameter of the wire conductor C is 0.09 mm or less (40 or more in AWG (American Wire Gauge)) and the arrangement pitch if the terminal elements 12 or 82 is 0.3 mm or less. The semi-hard conductor cable to which the connector 10 or 80 is applicable is formed, for example, of a conductor C of copper alloy plated with silver or tin and a sheath S of fluorine plastic such as polytetrafluoroethylene (PTFE), perfluoroalcoxyalcan (PFA) or perfluoroethylene-propene copolymer (FEP).

The connector 10 or 80 may be used in combination with a substrate connector 90 shown in FIG. 9. The substrate connector 90 has a well-known structure including a body 92 of a resinous molded article and a plurality of terminal elements 94 supported by the body 92. The body 92 of the substrate connector 90 includes a female type engagement section 96 detachably engageable with an auxiliary portion 36 of the first support member 20 (see FIG. 2) forming the body 16 of the connector 10 or 80. Contact sections 94*a* of a plurality of terminal elements 94 provided within the engagement section 96 are arranged to be individually connected to the contact sections 30 of the terminal elements 12 or 82 in the connector 10 or 80. The respective terminal element 94 in the substrate connector 90 has a lead section 94*b* formed at an end opposite to the contact section 94*a*, projected outward from the body 92 to be connected with a conductor pad formed on a substrate not shown. FIG. 10 illustrates the engagement of the connector 10 or 80 with the substrate connector 90.

As apparent from the above description, according to the present invention, in the wire connection structure having an abutting member for abutting a wire conductor to a conductor-connecting section of a terminal element, it is possible to avoid beforehand the damage of the wire conductor during the wire-connecting operation, and even to a wire having a semi-hard conductor, to ensure the stability and the reliability in conductive contact between the conductor and the terminal element. Further, according to the present invention, a high-density connection type connector employing such a wire connection structure excellent in stability and reliability is provided, which corresponds to the wire conductors having a smaller diameter and the terminal elements arranged at a narrower pitch.

EXPLANATION OF REFERENCE NUMERALS

Figure 1A:
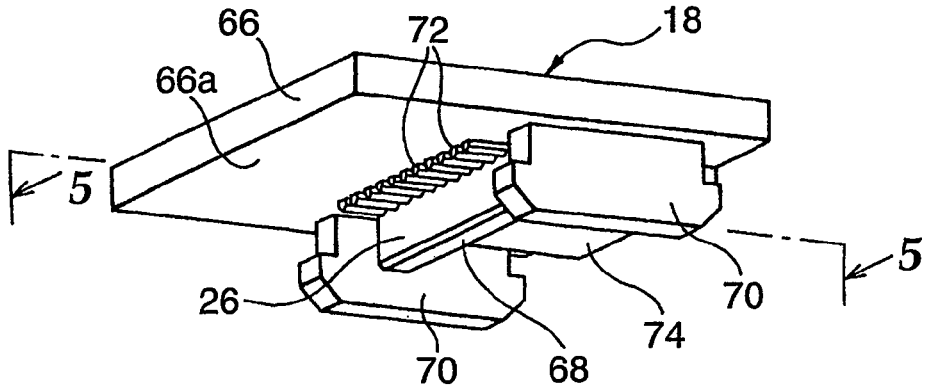
FIGS. 1(*a*) and 1(*b*) are illustrations of constituent elements of a connector according to a first embodiment of the present invention, wherein FIG. 1(*a*) is a perspective view of an abutting member and FIG. 1(*b*) is an exploded perspective view of a body.
Figure 1B:
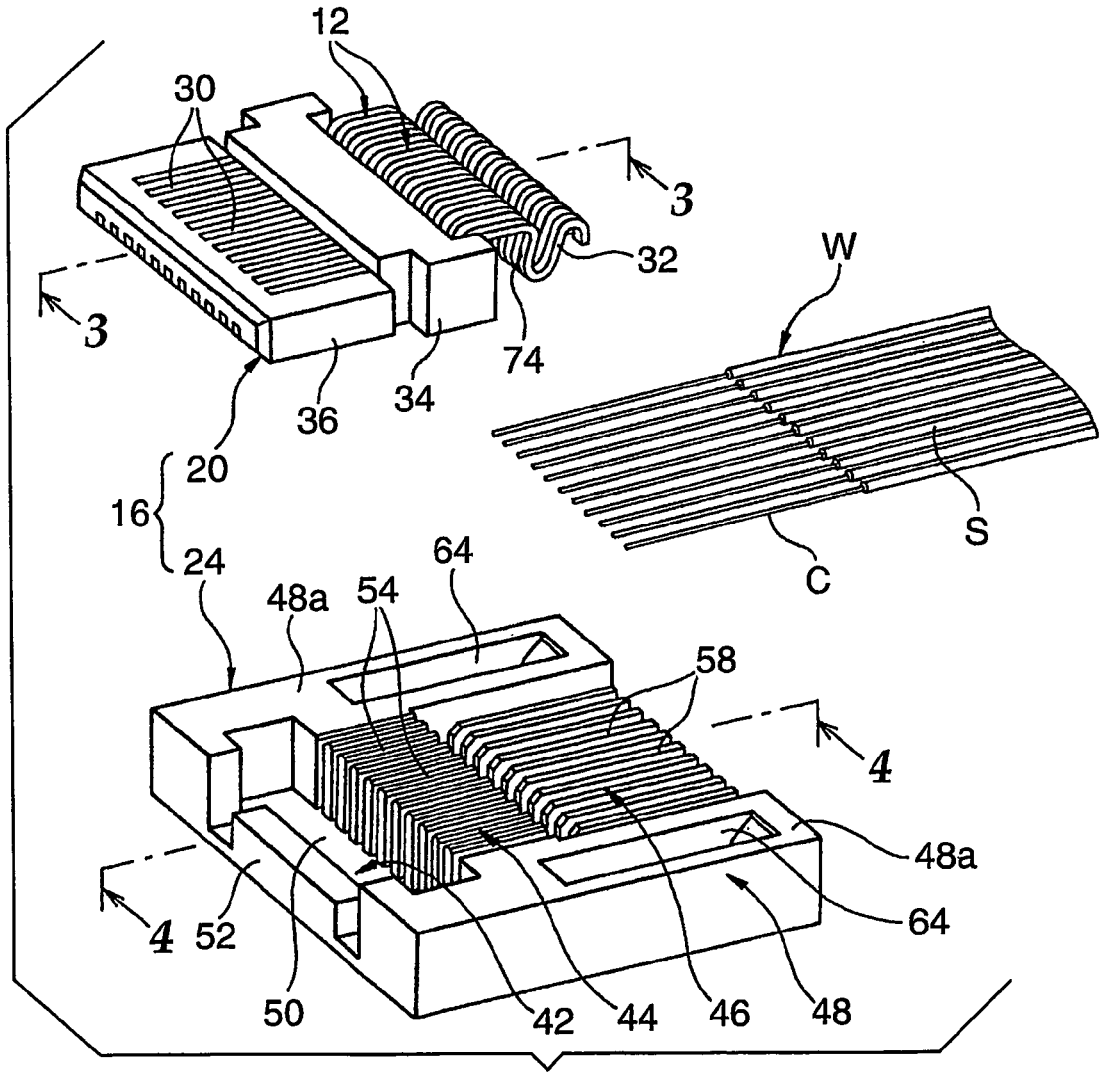
Figure 2:
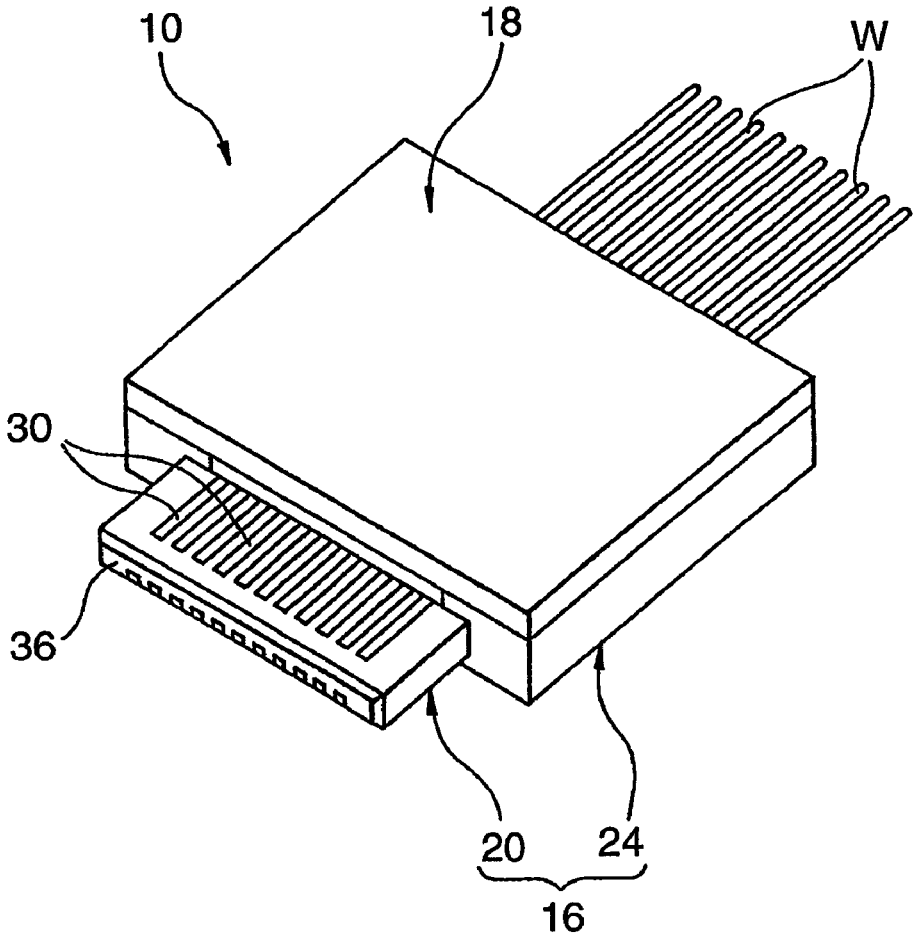
FIG. 2 is a perspective view of the connector shown in FIGS. 1(*a*) and 1(*b*) in an assemble state.
Figure 3:
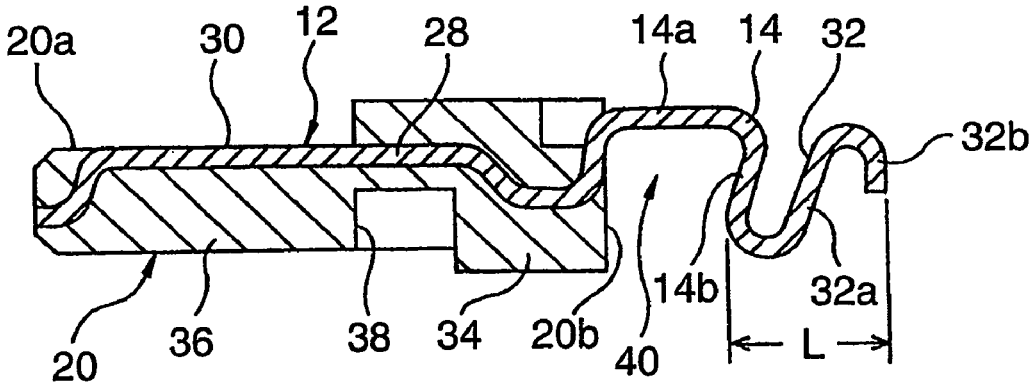
FIG. 3 is a sectional view of a first support member and a terminal element in the connector taken along a line III—III in FIG. 1(*b*).
Figure 4:
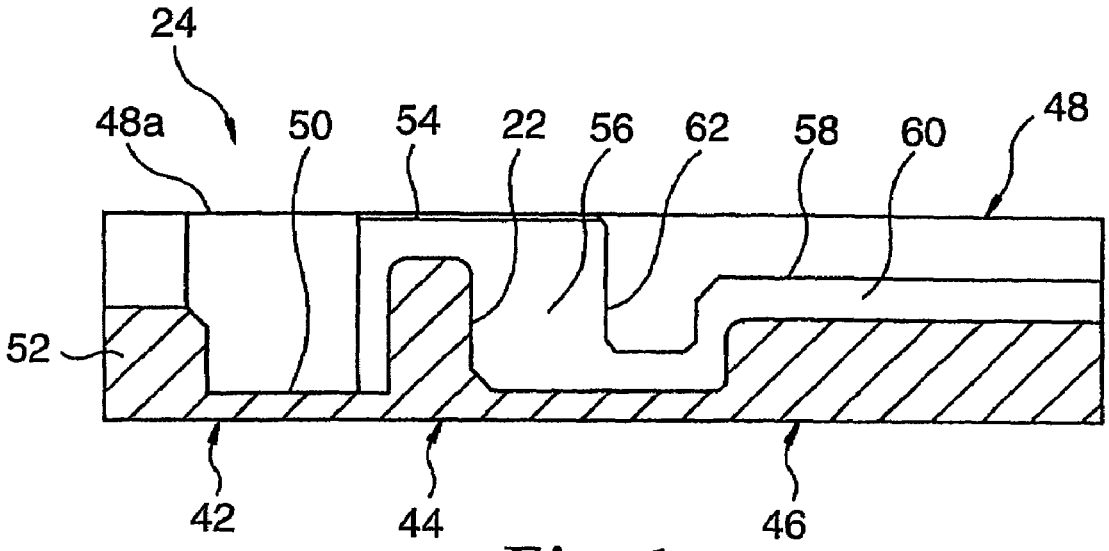
FIG. 4 is a sectional view of a second support member in the connector taken along a line IV—IV in FIG. 1(*b*).
Figure 5:
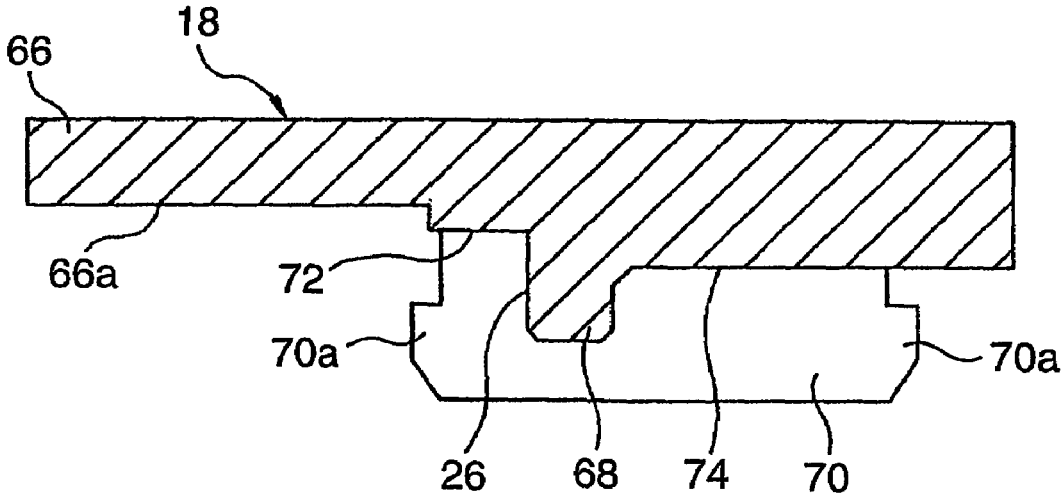
FIG. 5 is a sectional view of an abutting member in the connector taken along a line V—V in FIG. 1(*a*).
Figure 6A:
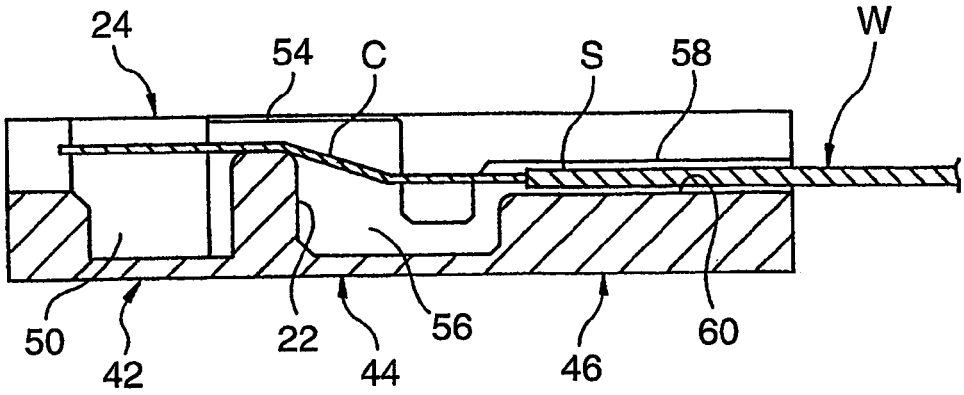
FIGS. 6(*a*), 6(*b*) and 6(*c*) are illustrations for explaining processes for connecting wires by the connector shown in FIGS. 1(*a*) and 1(*b*), wherein FIG. 6(*a*) is a state in which the wire is temporarily placed, FIG. 6(*b*) is a state in which the wire is temporarily fixed, and FIG. 6(*c*) is a state in which the wire connection has been completed.
Figure 6B:
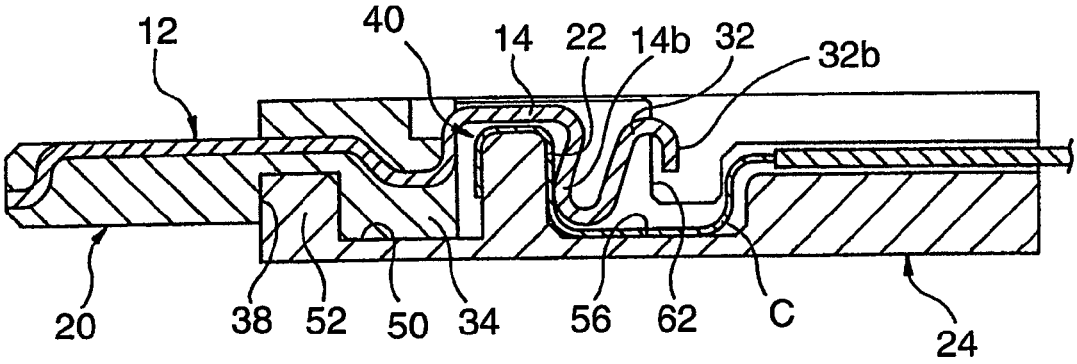
Figure 6C:
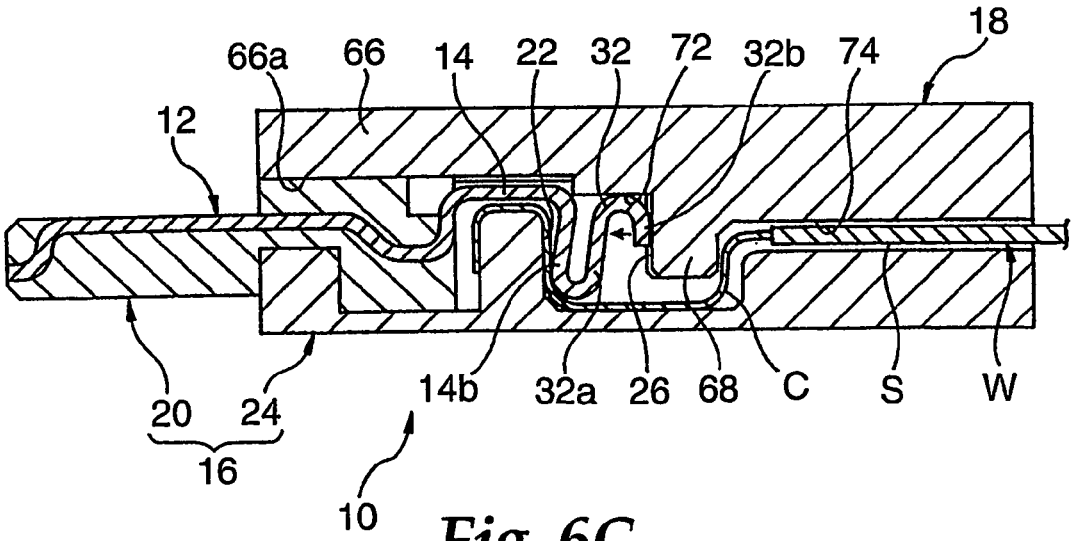
Figure 7:
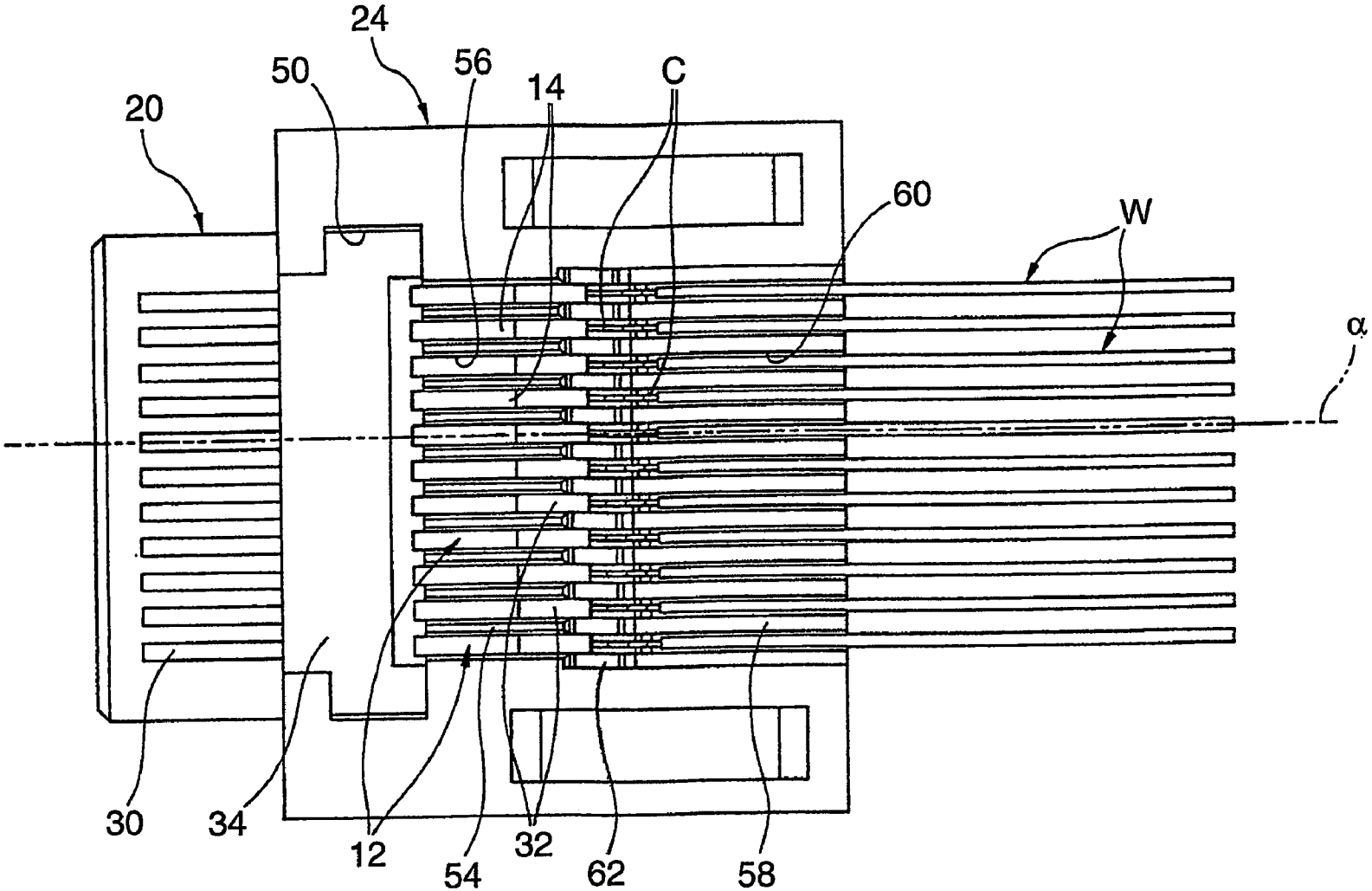
FIG. 7 is a plan view of a half-made connector 10 in which the wires are temporarily maintained as shown in FIG. 6(*b*).
Figure 8A:
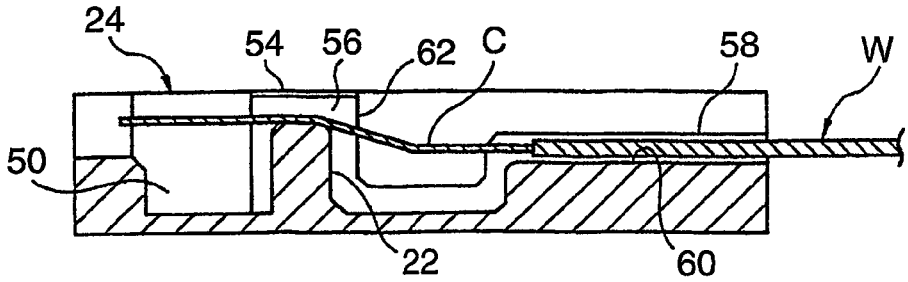
FIGS. 8(*a*), 8(*b*) and 8(*c*) are illustrations of constituent elements of a connector according to a second embodiment of the present invention, wherein FIG. 8(*a*) is a state in which the wire is temporarily placed, FIG. 8(*b*) is a state in which the wire is temporarily fixed, and FIG. 8(*c*) is a state in which the wire connection has been completed.
Figure 8B:
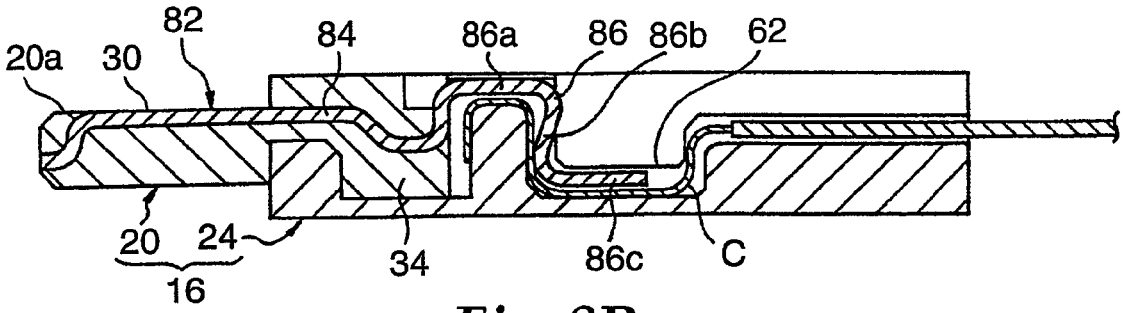
Figure 8C:
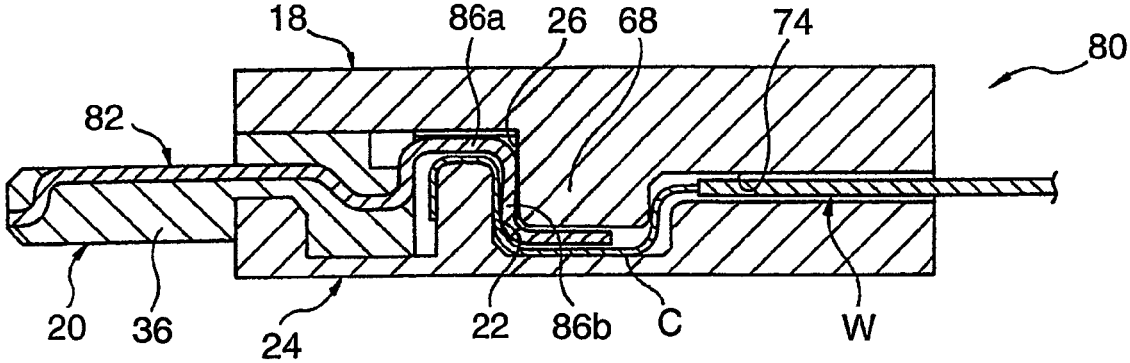
Figure 9:
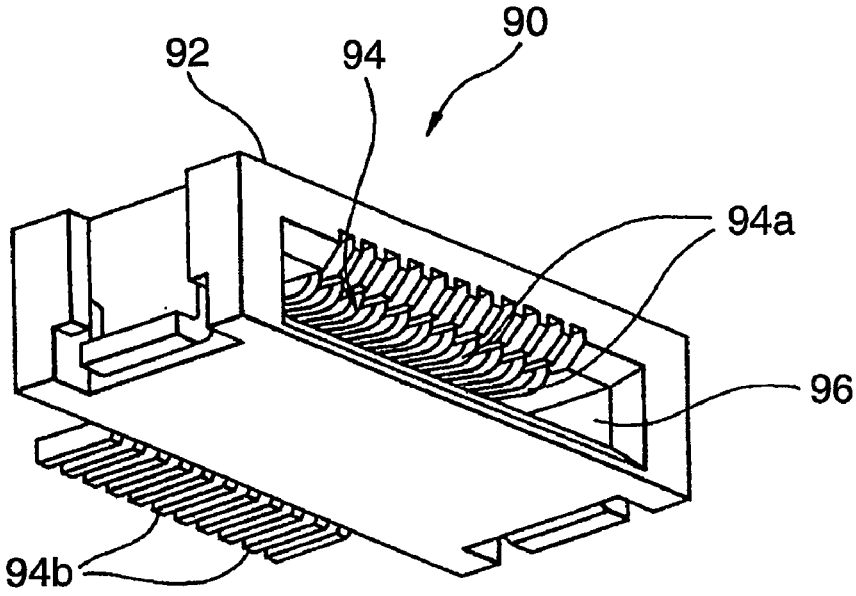
FIG. 9 is a perspective view of a substrate connector usable in combination with the connector shown in FIGS. 1(*a*) and 1(*b*) or FIGS. 8(*a*), 8(*b*) and 8(*c*).
Figure 10:
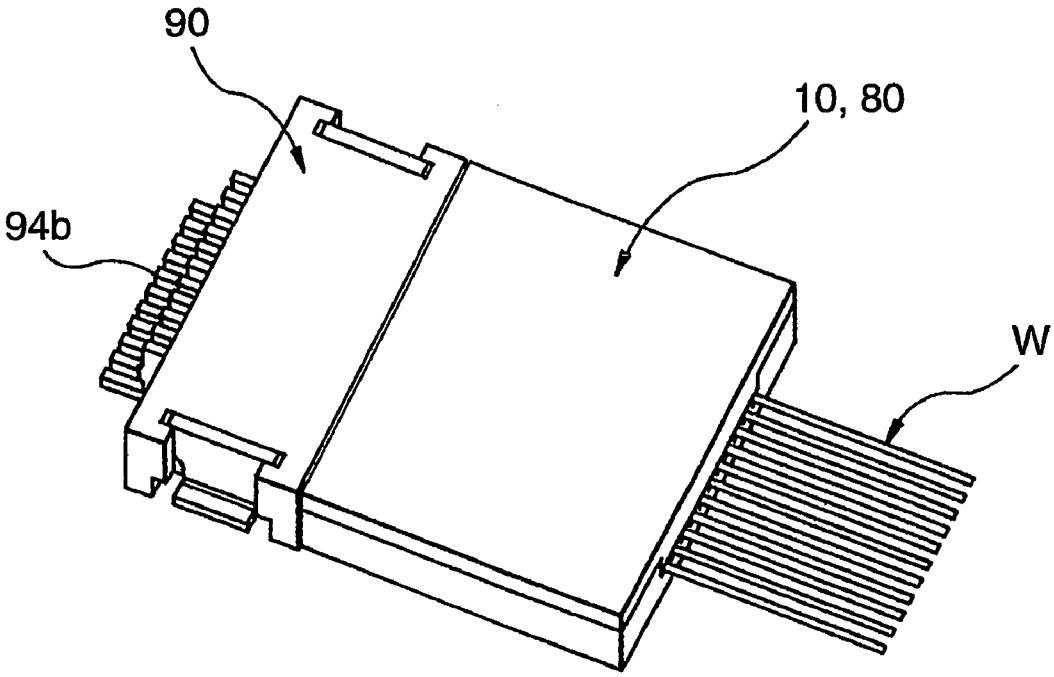
FIG. 10 is a perspective view of the assembly of the connector shown in FIGS. 1(*a*) and 1(*b*) or FIGS. 8(*a*), 8(*b*) and 8(*c*) and the substrate connector shown in FIG. 9.

10 80—connector
12, 22—terminal element
14, 86—conductor-connecting section
16—body (support)
18—abutting member
20—first support,member (first support section)
22—bearing surface
24—second support member (second support section)
26—pressing surface
32—spring section
62—recess
68—projection

What is claimed is:

1. A wire connection structure comprising a terminal element having a conductor-connecting section connectable to a wire conductor, an electrically insulative support for supporting the terminal element with the conductor-connecting section being exposed, and an abutting member for abutting a wire conductor to the conductor-connecting section of the terminal element under pressure, wherein said support includes a first support section supporting said terminal element and a second support section having a bearing surface opposed to said conductor-connecting section of said terminal element supported on said first support section, a wire conductor being disposed between said conductor-connecting section and said bearing surface;

said abutting member includes a pressing surface acting to push said conductor-connecting section of said terminal element supported on said first support section toward said bearing surface of said second support section, said abutting member includes a projection having said pressing surface, and said second support member includes a recess for receiving said projection of said abutting member, wherein said terminal element includes a spring section adjacent to said conductor-connecting section; and wherein said abutting member presses said spring section of said terminal element by said pressing surface, upon being assembled with said body, so that a wire conductor is held between said conductor-connecting section and said bearing surface under a spring force generated in said spring section.

2. A connector comprising a terminal element having a conductor-connecting section connectable to a wire conductor, an electrically insulative body for supporting the terminal element with the conductor-connecting section being exposed, and an abutting member assembled with the body for abutting a wire conductor to the conductor-connecting section of the terminal element under pressure, wherein said body includes a first support member supporting said terminal element and a second support member supporting said first support member and having a bearing surface opposed to said conductor-connecting section of said terminal element supported on said first support member, said first support member and said second support member being combined with each other to permit a wire conductor to be disposed between said conductor-connecting section and said bearing surface;

said abutting member includes a pressing surface acting to push said conductor-connecting section of said terminal element supported on said first support member toward said bearing surface of said second support member when said abutting member is assembled with said body, said abutting member includes a projection having said pressing surface, and said second support member includes a recess for receiving said projection of said abutting member, wherein said terminal element includes a spring section adjacent to said conductor-connecting section; and wherein said abutting member presses said spring section of said terminal element by said pressing surface, upon being assembled with said body, so that a wire conductor is held between said conductor-connecting section and said bearing surface under a spring force generated in said spring section.

* * * * *